United States Patent [19]

Etnestad et al.

[11] 4,303,022

[45] Dec. 1, 1981

[54] ARRANGEMENT IN INCINERATOR

[75] Inventors: Hermann Etnestad, Blomsterveien; Sverre Laugerud, Moreneveien, both of Norway

[73] Assignee: O. Mustad & Son, Gjovik, Norway

[21] Appl. No.: 207,730

[22] Filed: Nov. 17, 1980

Related U.S. Application Data

[63] Continuation of Ser. No. 12,750, Feb. 16, 1979, abandoned.

[30] Foreign Application Priority Data

Feb. 17, 1978 [NO] Norway ..... 780551

[51] Int. Cl.[3] ..... F23G 5/00; F23L 17/00

[52] U.S. Cl. ..... 110/245; 110/208; 110/259; 110/165 R

[58] Field of Search ..... 110/245, 268, 327, 328, 110/259, 165 R; 34/57 A, 57 R, 57 C; 432/58; 127/40

[56] References Cited

U.S. PATENT DOCUMENTS

| | | | |
|---|---|---|---|
| 1,183,478 | 5/1916 | Mathias et al. | 110/268 |
| 1,527,252 | 2/1925 | Rohn et al. | 110/259 |
| 2,653,596 | 9/1953 | Dunston | 110/327 |
| 3,225,721 | 12/1965 | Rowley | 110/259 |
| 4,048,927 | 9/1977 | Augustin et al. | 110/208 |
| 4,102,777 | 7/1978 | Wall | 110/245 |
| 4,156,393 | 5/1979 | Mallek et al. | 110/208 |
| 4,156,394 | 5/1979 | Mallek et al. | 110/208 |
| 4,167,146 | 9/1979 | Wirth | 110/259 |

*Primary Examiner*—Henry C. Yuen

*Attorney, Agent, or Firm*—Finnegan, Henderson, Farabow, Garrett & Dunner

[57] ABSTRACT

The constriction plate in a fluidized bed incinerator is pivotally mounted for swinging movement down into the windbox. Thereby, the fluidized bed can be rapidly emptied into the windbox, whereby heat sensitive members in the incinerator will not be damaged by the hot refractory particles in the bed.

3 Claims, 1 Drawing Figure

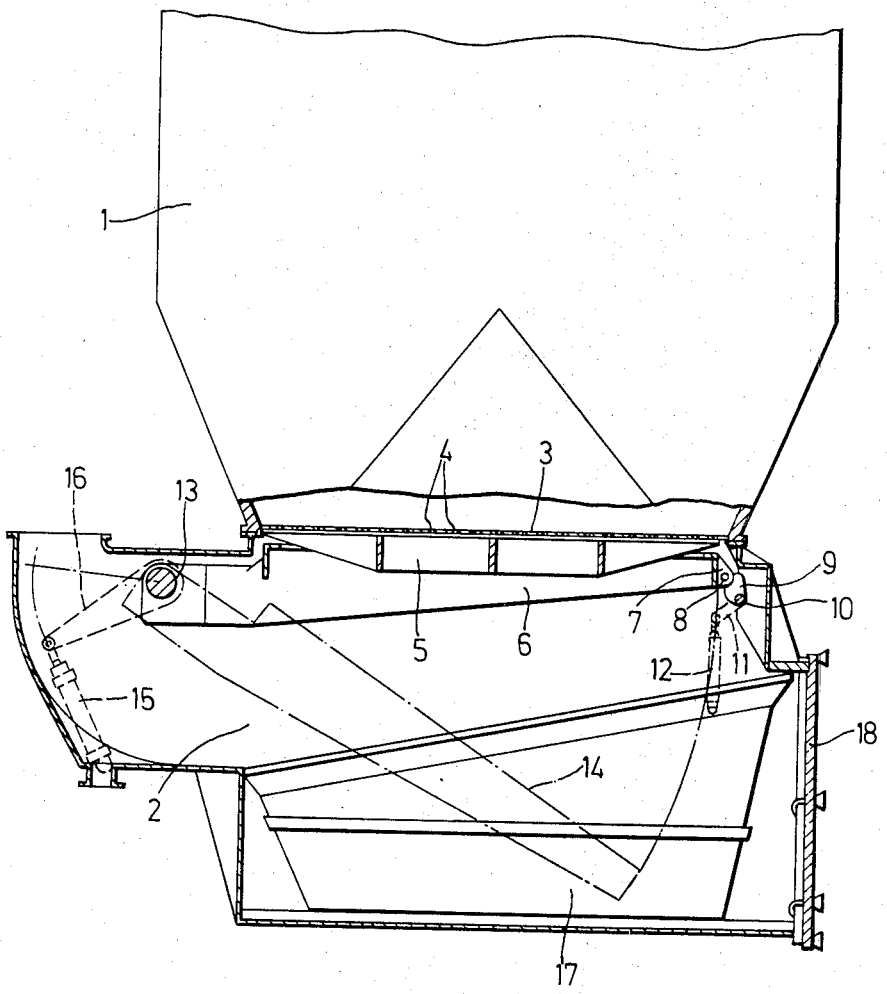
1
2
3
4
5
6
7
8
9
10
11
12
13
14
15
16
17
18

ARRANGEMENT IN INCINERATOR

This is a continuation, of application Ser. No. 012,750, filed Feb. 16, 1979, now abandoned.

BACKGROUND OF THE INVENTION

The present invention relates to an arrangement in incinerator in which fuel is burned in a fluidized bed of refractory particles and the fluidizing air is supplied from a windbox through a constriction plate which carries the fluidized bed In incinerators operating with a fluidized bed of refractory particles, e.g. sand, pipe coils are often used in the fluidized bed for the circulation of a coolant for cooling the bed. If the circulation of coolant fails, the pipe coils may burn out. A burning out of the coils, the tuyeres or other members arranged in the incinerator may also occur if for other reasons the temperature of the bed should become excessive.

The object of the present invention is to provide an arrangement in incinerators of the above mentioned type which allows the incinerator to be rapidly put out of operation and at the same time protects costly and sensitive elements of the incinerator from the residual heat in the fluidized bed.

SUMMARY OF THE INVENTION

The arrangement according to the invention is characterized in that the constriction plate can be lowered and raised between a normal position in which it carries the fluidized bed, and a position down in the windbox in which the bed is emptied into the windbox and fluidization is interrupted. The constriction plate is preferably pivotally mounted about an axis at one edge of the plate.

In this way it is possible quickly to empty the bed of refractory particles into the windbox, preferably into an ash pit arranged therein. Such emptying can be triggered by excessive temperature in the fluidized bed, by a failure in the circulation of coolant in any pipe coils, if provided, or by other factors which necessitate a rapid shut down of the incinerator and emptying of the bed of hot refractory particles into the windbox. The constriction plate can for example be lockable in its normal position to hold the weight of the plate and the fluidized bed. Upon unlocking the constriction plate will then of its own accord swing down into the windbox and empty the sand bed thereinto. The swinging of the constriction plate by gravity may be suitably braked so that controlled movement is achieved. The braking means can preferably take the form of hydraulic cylinders which can also serve to raise the constriction plate to the normal position.

Besides serving for rapidly emptying the fluidized bed in an emergency situation, the arrangement according to the invention can of course also be employed when the sand bed is to be replaced. Furthermore, the arrangement according to the invention allows greater ease of inspection and maintenance of the incinerator.

DESCRIPTION OF THE PREFERRED EMBODIMENT

The invention is further described below, reference being had to the drawing, which is a highly diagrammatic elevation, partly in section, of an incinerator constructed in accordance with the invention.

The drawing shows a combustion chamber 1 of circular cross section, which at its lower end narrows gradually on four sides to an approximately square cross section at the lower end of the combustion chamber. Under the combustion chamber 1 a windbox 2 is provided, as conventional, said windbox serving for supplying fluidizinggas through a constriction plate 3 which forms the bottom of the combustion chamber 1. The constriction plate 3 in conventional manner carries a layer of refractory particles, e.g. sand. In the embodiment shown in the drawing the constriction plate 3 consists of a metal plate with holes 4, but it will be understood that the constriction plate 3 can be of many other designs, and that instead of simple holes 4 it is possible to employ more complicated tuyeres of the kind known in the fluidized bed art.

In the embodiment shown the constriction plate 3 is carried by a supporting frame 5 which in turn is carried by arms 6 mounted on a rotatable shaft 13 at one side of the incinerator. At its free end each arm 6 is provided with lugs 7 having a journal pin 8 which is supported on a rotatable cam 9 which is journaled on a shaft 10. The shaft 10 extends out of the windbox to both sides thereof and outside the windbox carries levers 11 which can be actuated by hydraulic cylinders 12. When the shaft 10 is turned in order to bring the cams 9 out of engagement with the journal pins 8, the arms 6 will no longer be supported at their free ends, and the arms 6, the supporting frame 5 and the constriction plate 3 will swing down under the force of gravity to the position indicated at 14 by the dot and dash lines. The movement is braked by hydraulic cylinders 15 which are arranged on both sides outside the windbox 2 and act upon levers 16 which are connected to the shaft 13. The cylinders 15 also serve to lift the arms 6 and thereby also the constriction plate 3 up into the normal position shown in the drawing, in which the arms are locked by the cams 9.

When the constriction plate 3 swings down to the position shown at 14, the sand bed will be emptied into an ash and sand container 17 provided in the windbox. The container can for example be supported on rails and be drawn out of the windbox 2 after a hatch 18 has been opened.

What we claim is:

1. A fluidized bed incinerator comprising:

a combustion chamber, including a constriction plate forming the bottom of the combustion chamber;

a windbox for supplying fluidizing gas through said constriction plate to said fluidized bed;

said constriction plate supporting the material forming said fluidized bed when said fluidizing gas is shut off and preventing substantially all of said bed material from entering said windbox during normal operation of said incinerator; and emptying means for rapidly emptying said bed into said windbox including a pivotal mounting on one end of said constriction plate permitting rotation of said plate about said mounting into said windbox; and releasable locking means including a lug mounted on said plate at the opposite end from the pivotal mounting and a rotatable cam interacting with said lug for normally supporting the opposite end of said plate.

2. the incinerator of claim 1 including means for braking said rotation of said plate.

3. The incinerator of claim 2 wherein said braking means includes one or more hydraulic cylinders.

* * * * *